United States Patent [19]

Ferro

[11] 4,101,168

[45] Jul. 18, 1978

[54] ADJUSTABLE CHAIR

[75] Inventor: Arthur Charles Ferro, St. Louis, Mo.

[73] Assignee: Contour Chair-Lounge Co., Inc., St. Louis, Mo.

[21] Appl. No.: 750,917

[22] Filed: Dec. 15, 1976

[51] Int. Cl.[2] ..... A47C 1/024

[52] U.S. Cl. ..... 297/329; 297/330; 248/430

[58] Field of Search ..... 297/330, 329; 248/436, 248/429, 424; 5/63, 68, 62

[56] References Cited

U.S. PATENT DOCUMENTS

| | | | |
|---|---|---|---|
| 2,921,621 | 1/1960 | Williams et al. | 297/330 X |
| 3,174,161 | 3/1965 | Black | 5/68 |
| 3,232,575 | 2/1966 | Ferro | 248/430 |

*Primary Examiner*—Francis K. Zugel
*Attorney, Agent, or Firm*—Rogers, Eilers & Howell

[57] ABSTRACT

A positionable chair-lounge has a base which has transverse support beams, a movable top section that has transverse beams and is supported upon rollers that engage arcuate tracks secured to the base, a gear head motor type of power assembly which directly drives a threaded shaft and a drive tube through an irreversible drive. One end of the power assembly is pivotally attached to the top section by a guiding bracket and the other end is pivotally attached to the base by a guiding bracket. The base and seat transverse beams and the power assembly are positioned so that the seat can be moved in an arcuate path relative to the base.

2 Claims, 10 Drawing Figures

20
8
8
4
4
104
110
190
200
112
80
54
149
114
140
170
196
118
288
214
26
134
153
126
100
130
24
122
106
90
58
84
22
164
50
40
42
180
216
69
68
243
270
64
30
72
36
34
46
281
268

7
7
5
5
20
24
104
110
202
194
198
102
165
92
58
82
32
64
214
137
26
210
268
236
270
243
281
210
216
69
68
224
50
122
46
114
80
30
118
164
54
200
112
190
22
196
288
134
100
126
130
90
106

20
24
122
106
110
190
130
100
200
112
80
54
118
288
26
214
134
126
153
90
164
114
140
196
281
58
180
224
72
36
149
170
268
216
42
22
34
46
72
270
243
84
50
40
64
69
68

ADJUSTABLE CHAIR

BACKGROUND OF THE INVENTION

This invention relates to powered positionable chairs in which a top section supported by a base is moved in an arcuate path relative to the base. A problem of paramount importance with positionable chairs that provide arcuate seat movement is that the power assembly components and the seat and base must be so structured that they will not interfere with one another during operation. The sections must be strongly based with transverse bracing, and yet must provide clearance for movements of the power drive mechanism. This problem is particularly acute in a positionable chair that provides arcuate movement, as distinguished from one which provides only linear movement of the seat relative to the base, as the power drive parts are more or less chordal to the arc of movement.

Powered positionable chairs that have arcuate seat-base movement are known in the prior art. For example, in Ferro U.S. Pat. No. 3,232,575, there is disclosed a positionable chair in which a seat is moved in an arcuate path relative to the base. In such prior art chairs that rely on a pulley belt system, there has existed a problem of maintaining alignment of the pulley belt, especially when the pulleys are tilted relative to one another during chair operation. Also such pulley arrangements can add to the complexity of a power mechanism.

Prior art devices have had a tendency to move themselves out of alignment during chair operation, and there has been a need to have a mounting system which can guide the operation of the power assembly so that alignment of the power assembly with the seat and base is maintained.

Problems have also existed in the prior art with the length of time expended in detaching a power assembly from a chair so that maintenance on the assembly can be performed on location without obstruction from the chair parts. Such detachment also eliminates the necessity of removing the entire chair to a repair shop should it be necessary to take the power assembly to the repair shop. There has been a desire to reduce the complexity of the mounting for power assemblies so that detachment of the power assembly can be performed easily.

Problems have also existed in the prior art with the length of time expended in detaching a power assembly from a chair so that maintenance on the assembly can be performed on location without obstruction from the chair parts. Such detachment also eliminates the necessity of removing the entire chair to a repair shop should it be necessary to take the power assembly to the repair shop. There has been a desire to reduce the complexity of the mounting for power assemblies so that detachment of the power assembly can be performed easily.

Complexity of prior arcuate movement power assemblies has also made handling of the assemblies awkward and there has been a need for a power assembly that can be handled easily in positioning it in an arcuate movement chair.

In the prior art, as arcuate movement of the seat occurs, exposed power assembly parts can move into chair clothing and upholstery and it has been desired to conceal moving assembly parts to avoid such contact.

SUMMARY OF THE INVENTION

The present invention improves over the prior art. It comprises a power assembly and a mounting arrangement which allows for pivotal engagement of the ends of the power assembly to the movable top section and to the base, respectively, with only one engagement of the power system to the top and one engagement of the power system to the base.

The present invention also has guiding brackets which allow the ends of the power assembly to be pivotally mounted but yet provide for guidance of the ends of the power assembly so that the assembly does not move laterally from side to side of the chair and thus become misaligned so as to impair functioning. The power assembly is so designed as to be confined substantially to the limits of the base section with the resulting ability to provide a full complement of transverse braces in the top section. Yet further, the design also permits full bracing of the base, by the added expedient of disposing those braces flatwise.

The transverse cross beams of the top section and of the base thus do not interfere with the power assembly during the movement of the seat relative to the base, and yet proper rigidity and strength is provided.

The present invention also allows the screw shaft to be covered during its powering movement so that it does not become engaged to chair upholstery or clothing. Maintenance can be performed with a minimum amount of time and effort as the power assembly can be detached at two points and removed from the chair. This allows simple repairs to be made at the location of the chair, and allows more complex repairs to be made at a repair shop without taking the entire chair to the shop.

The present invention also allows for the transverse members to be arranged so that either end of the power assembly can be attached to the base and to the seat.

DESCRIPTION OF THE PREFERRED EMBODIMENT

Figure 1:
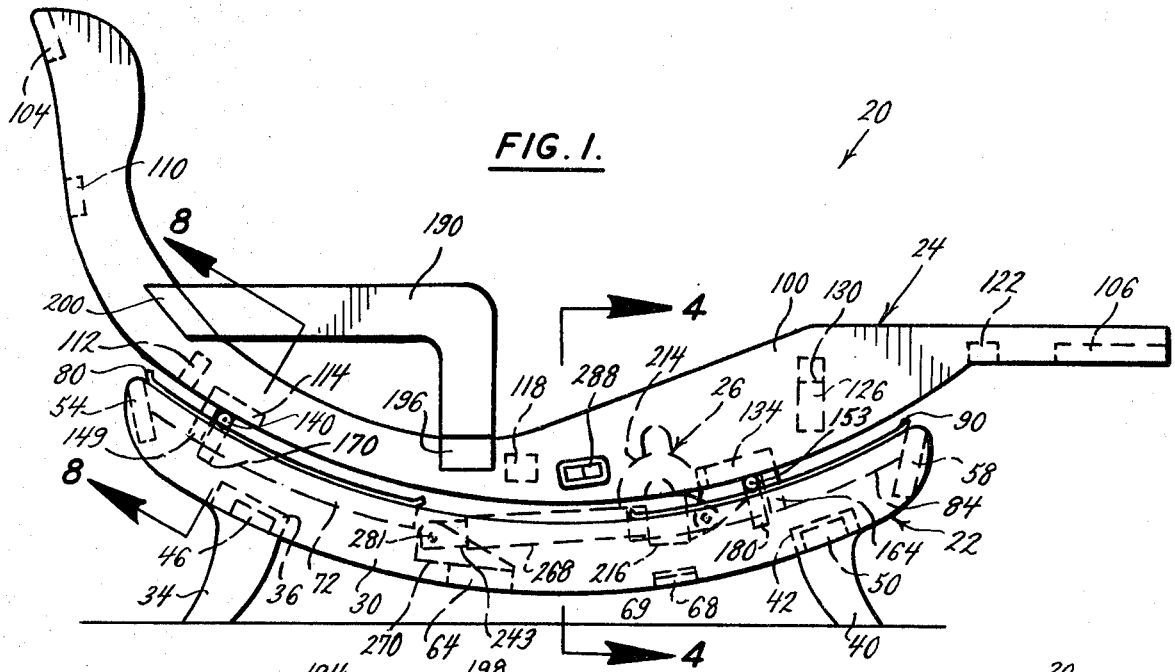
FIG. 1 is a front side view of the positionable chair showing the foot end of the chair to the right and in its lowest position.
Figure 2:
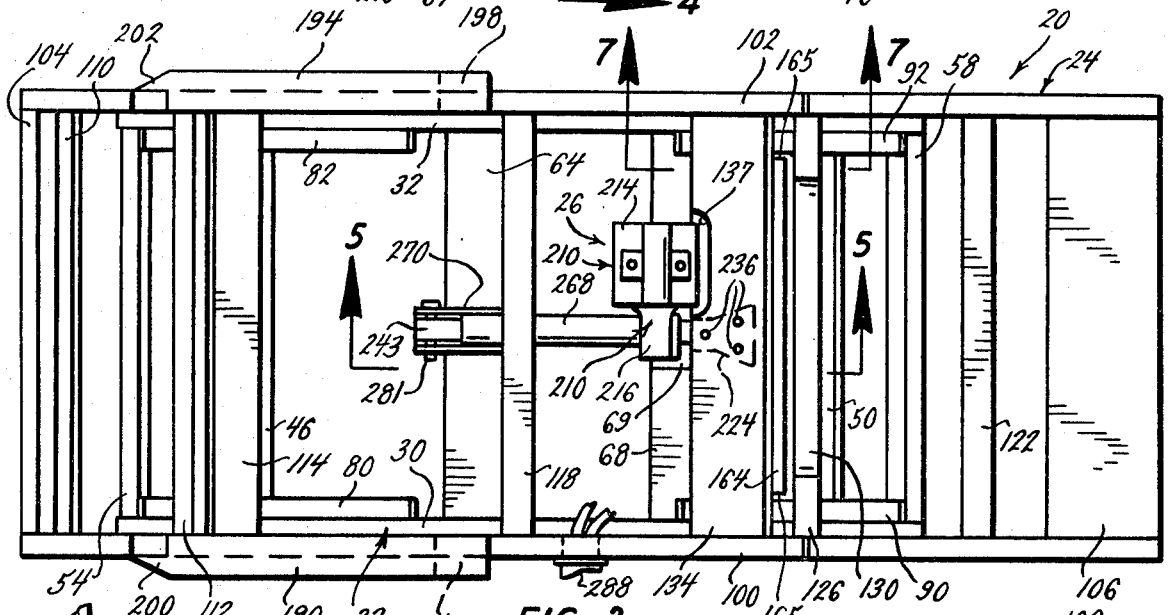
FIG. 2 is a top plan view of the chair showing the foot end of the chair in its lowest position.

The positionable chair-lounge generally indicated in the drawings as 20 has for its main components a four-sided base 22 which supports a movable top 24, with a power assembly 26 engaging the top 24 with base 22 so that the seat can be driven along an arcuate path relative to the base without the collision of the motor assembly 26 against parts of the seat or base during such movement. The base 22 and seat 24 have upholstery and padding well known in the art to provide comfort, which is not shown in the present drawings for purposes of clarity.

The base 22 has two arcuate side rails 30 and 32 which have legs 34 secured to their opposite ends. The upper ends of the legs 34 are rabbeted to receive the side rails, with interior upper extensions 36 which are secured to the interior sides of the side rails 30 and 32, while the bottoms of the side rails 30 and 32 rest on the horizontal surfaces of the rabbets of the legs 34. One such leg is shown in FIG. 1. At the foot end of the base are two legs 40 similar to, and similarly mounted to, the legs 34.

To provide stabilization and rigidity for the base 22, transverse support means is provided. Cross beam 46 extends across the base head end and has its ends secured as by glue and/or screws (not shown) to the extensions 36 of the legs 34 and to the side rails 30 and 32. In like manner, near the foot end of the base a cross beam 50 has its ends secured to the upper extensions 42 of legs 40 and to the sides of panels 30 and 32.

At the head end of the base, and at the foot end of the base, cross beams 54 and 58, respectively, have their ends secured to the side panels 30 and 32. A mounting cross beam 64 which provides support for the power assembly as will be described, and an intermediate cross beam 68 having a notch 69 on its upper end, both have their ends secured to the side panels 30 and 32. The beams 54, 58, 64 and 68 all can be secured to panels 30 and 32 as by screws (not shown) and/or glue. The aforementioned base cross beams maintain rigidity of the base 22, and as will become manifest, they are positioned so as not to collide with the power assembly 26 during movement of the assembly and the seat 24. The aforementioned side panels or rails, legs and cross beams can all be of wood or the like.

Figure 8:
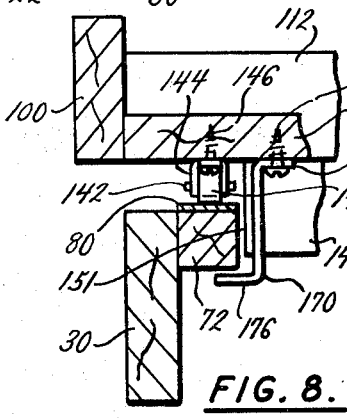
FIG. 8 is a view of the roller-track arrangement at the head end of the chair taken on the line 8—8 of FIG. 1.

The base 22 has arcuate tracks to provide support for rollers on the top, that are yet to be described. At the head end of the base, arcuate wooden support strips 72 and 76 are secured to the interior upper sides of the side rails 30 and 32, respectively, as by screws and/or glue (not shown), with the head ends of the strips supported upon the face of cross beam 54. Conforming arcuate metal tracks 80 and 82 are secured to the upper sides of the arcuate support strips 72 and 76, respectively, as by screws (not shown). FIG. 8 shows a section through the foregoing.

At the foot end of the base 22, similar arcuate wooden strips 84 and 86 are secured to the upper interior sides of panels 30 and 32, respectively, as by glue and/or screws (not shown) with the foot ends of the strips supported upon the face of cross beam 58. Conforming arcuate metal tracks 90 and 92 are secured as by screws (not shown) to the upper sides of support strips 84 and 86, respectively. See especially FIG. 7. The arcuate metal tracks 80 and 90 on the front side of the chair and the metal tracks 82 and 92 on the rear side of the chair are all curved so that they are segments of a circular arc. Such arcuate track elements allow predictability for the motion of the seat 24 and power assembly 26.

The top section 24 has a structure which allows it to move in an arcuate path relative to the base 22 so that its components do not collide with components of the base or with components of the power assembly 26. The top 24 comprises curved side panels or rails 100 and 102 which are interconnected by transverse interconnecting means to provide rigidity and strength. The transverse interconnecting means comprises a head end cross beam 104 and a foot end cross beam 106, as well as intermediate cross beams 110, 112, 114, 118 and 122, each of which has its ends secured to the interior side of seat side panels 100 and 102 as by glue and/or screws (not shown).

There is also an intermediate cross beam 126 which has a notched upper midsection 130 provided for seating comfort, and a cross beam 134 which has a slot 137 to permit pivotal movement of a portion of the power assembly 26 so that part of the power assembly 26 can be mounted on beam 134. Both beams 126 and 134 have their ends secured to side panels 100 and 102 as by glue and/or screws (not shown).

The top section 24 also has means to allow the seat to roll in an arcuate path along the tracks of the base 22. At the head end of the top 24 on the underside of either end of the cross beam 114 are roller wheels 140 rotatably mounted by axle pins 142 within U brackets 144 which are secured by screws 146 to the cross beam 144, one such roller assembly being shown in FIG. 8. To guide and laterally confine the rollers 140 along the tracks 80 and 82 an alignment beam 149 has its upper side secured to the underside of cross beam 144 as by screws (not shown) so that both ends 151 of alignment beam 149 are in close relationship to the interior sides of the track support strips 72 and 76 as seen for the front side of the chair in FIG. 8, so that the ends 151 will engage the strips to resist lateral movement of the top relative to the base during operation. The ends 151 can be lubricated with grease to reduce friction between alignment beam 149 and the strips 72 and 76.

Figure 7:
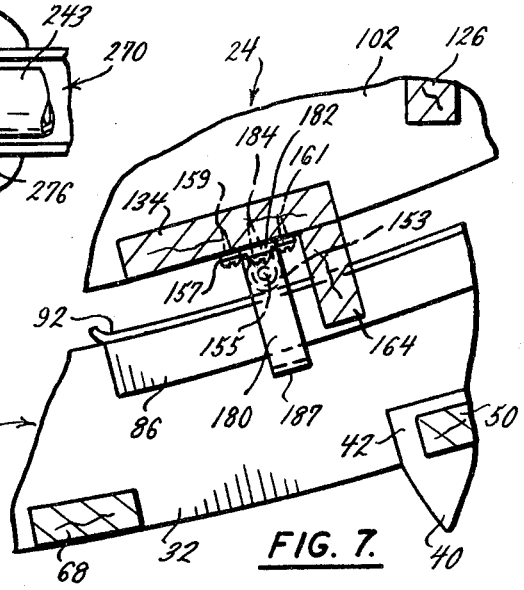
FIG. 7 is a side view showing part of the track and roller arrangement at the foot end of the chair, taken on the line 7—7 of FIG. 2.

At the foot end of seat 24 there is likewise a roller arrangement located at either end of the mounting cross beam 134, comprising roller wheels 153 rotatably mounted by axle pins 155 within the sides of U brackets 157 whose bases are secured to the underside of cross beam 134 as by screws 159 and 161, as seen for one end of cross beam 134 in FIG. 7.

An alignment beam 164 is secured to the underside of cross beam 134 as by screws (not shown) so that each of its ends 165, which can be greased for lubrication, are sufficiently near the interior sides of the track support strip 84 and 86 to maintain lateral alignment of the top section with the base.

To maintain the top section 24 vertically in engagement with the base 22, S-shaped retaining brackets 170 (as seen for the front side of the chair in FIG. 8) have their upper flanges 172 secured to either end of cross beam 114 as by screws 174 so that their lower flanges 176 extend beneath the track support strips 72 and 76. In like manner, S-shaped retaining brackets 180 (as seen for the rear side foot end bracket in FIG. 7) have their upper flanges 182 secured as by screws 184 at either end of the mounting cross beam 134 so that the bottom bracket flanges 187 extend beneath the track support strips 84 and 86. The retaining brackets 170 and 180 thus act through engagement of their lower flanges against the support strips to prevent the seat 24 from being moved upwardly away from the base 22 so that the rollers can maintain their alignment with, and be prevented from vertical dis-engagement from, their respective tracks.

The seat or top portion 24 has L-shaped arms 190 and 194, which have lower side end extensions 196 and 198, respectively, that extend against the exterior sides of side panels 100 and 102 so that they can be respectively secured thereto as by screws (not shown). Arms 190 and 194 also have upper end side extensions 200 and 202, respectively, which are secured against the exterior sides of side panels 100 and 102, respectively, as by glue and/or screws (not shown). The aforementioned seat side panels, seat cross beams, alignment beams, and arms can be made of wood or the like.

The power assembly 26 that comprises an electric motor, a reducing gear, and an extensible screw drive means, provides the means to move the seat 24 relative to the base 22. The assembly 26 comprises a gear head type motor system 210 which has a reversible AC motor unit 214 of appropriate size, and a speed-reducing gear box 216. Connected to the foot end portion of gear box 216 as by bolts 218 is a projecting pivot lug 221.

To mount the foot end portion of the power assembly 26, a V-shaped U-bracket 224 has side walls 227 and 229 which each have parallel end sections 231 and 233 for reception of the lug 221. The bracket 224 is secured to the underside of mounting beam 134 by nut and bolt assemblies 236 which are arranged in a triangular pattern to provide stable support for the bracket. The motor pivot lug 221 extends between the parallel bracket ends 231 and 233 and a pivot pin 238 extends through conforming aligned bores in the ends 231 and 233 and through a bore in lug 221 so as to pivotally secure the power assembly 26 to the bracket 224 and to the mounting beam 134. Pivot pin 238 is held in place by lock pins 239 which extend through bores on either end of pin 238 outside of parallel walls 231 and 233.

Figure 9:
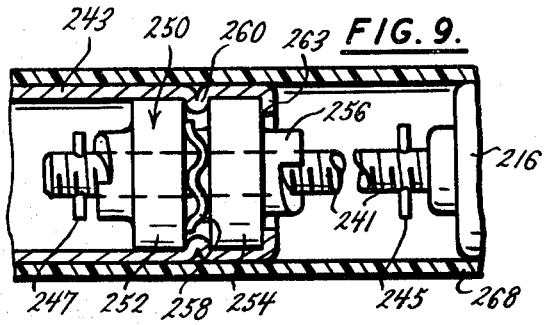
FIG. 9 is a view of part of the power assembly showing the motor shaft broken and showing the rider assembly.

The gear box 216 has a transmission which enables it to rotatably drive a threaded drive shaft 241 at an appropriate speed. The gearing is irreversible (as by a worm type drive) so that parts will be held in any position to which they are moved by the motor. Shaft 241 extends toward the head end of the chair from the gear box 216 into a cylindrical drive tube 243. As seen in FIG. 9, a pin 245 extends through and is secured to the threaded shaft adjacent the gear box while a similar pin 247 extends through and is secured to the shaft 241 at the other end of shaft 241.

Means are provided to allow the rotary movement of shaft 241 to cause linear movement of the drive tube 243 relative to the shaft. The action enables the motor system 210 to displace the drive tube 243 to an extreme in either direction, and thereafter to "free-wheel", i.e., continue rotating without driving the tube. These parts are from a commercially available drive mechanism. Partially enclosed within the foot end of drive tube 243 can be a rider assembly mechanism 250 having a structure similar to that shown in U.S. Pat. No. 3,232,575. The rider assembly 250 operates as described in said patent and the specification of said patent is incorporated by reference herein. The rider assembly 250 shown in FIG. 9 has an interior ring 252 and an exterior ring 254. A sleeve 256 extends within the two rings 252 and 254. A sleeve 256 extends within the two rings 252 and 254. A leaf spring 258 can be positioned between the rings 252 and 254 as disclosed in the incorporated patent.

To hold rider assembly 250 within the foot end of drive tube 243 an annular V-shaped detent 260 is crimped into drive tube 243 to extend from the interior wall of drive tube 243 between the two rings 252 and 254 (FIG. 9). The end 263 of the tube 243 is crimped at the foot end of drive tube 243 to abut the exterior side of the ring 254, and thus acts with detent 260 to sandwich ring 254 holding it and the rider assembly 250 within tube 243.

The shaft pins 245 and 247 act in the same manner as the shaft pins in the incorporated patent to disengage the drive of the shaft 241 from drive tube 243 when the pins 245 or 247 strike the shoulders of sleeve 256.

The motor 210 can be operated by a standard rocker switch as will be described, so that the drive shaft 241 can be rotated in either direction about its axis or can be stopped in a locked position.

Figure 10:
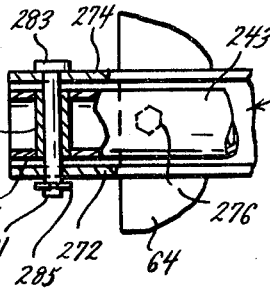
FIG. 10 is a top view of the pivotal engagement of the power assembly to the base.

The head end of drive tube 243 has aligned transverse circular bores 264 which receive and hold as by a press fit a metal cylindrical sleeve 266 (hidden lines of FIG. 10). The sleeve is adapted to receive a rocking pin to be described.

To prevent exposure of drive shaft 241 a cylindrical protective tube 268 is connected to gear box 216 as by screws (not shown). Drive tube 243 slidingly telescopes into protective tube 268 to permit movement of drive tube 243 within protective tube 268 and to enclose the drive shaft 241 during such movement. This prevents clothing and other articles from becoming caught in the movement of the parts.

Figure 5:
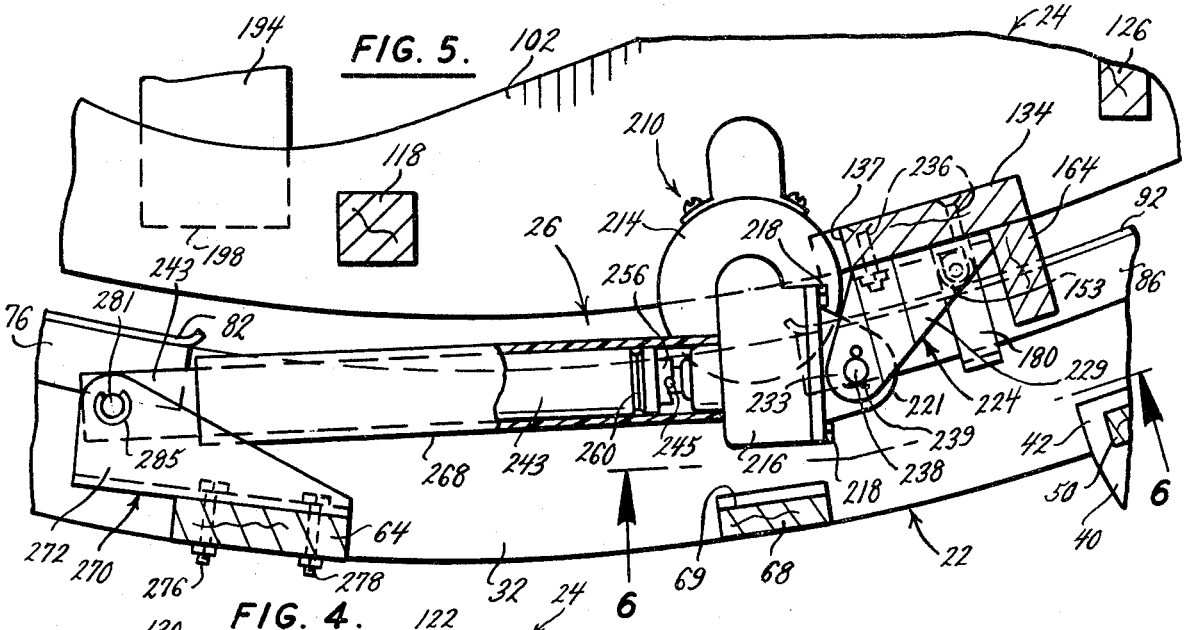
FIG. 5 is a section of the chair taken on line 5—5 of FIG. 2.
Figure 4:
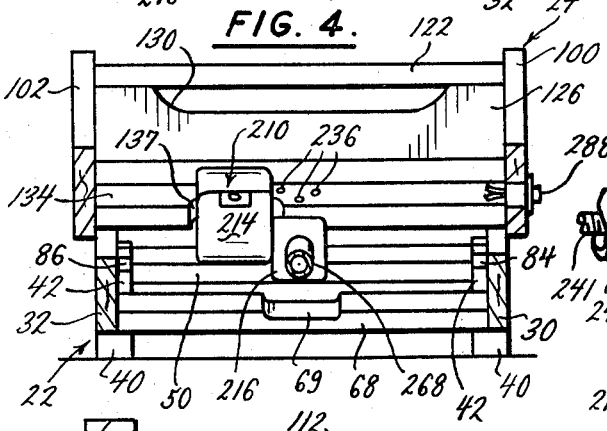
FIG. 4 is a section taken on the line 4—4 of FIG. 1, not showing the track elements, rollers or alignment beam for purposes of clarity.
Figure 6:
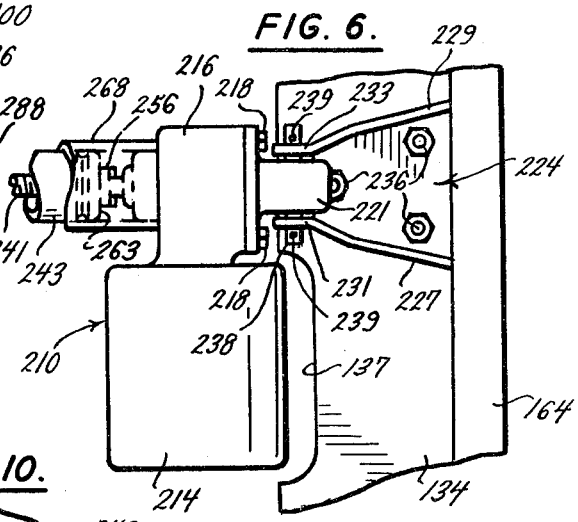
FIG. 6 is a bottom view of the pivotal engagement of the power assembly to the seat taken on the line 6—6 of FIG. 5.

To enable the motor arrangement 210 to act against the base to propel the seat in an arcuate path, a U bracket 270 having inclined sides 272 and 274, has its base secured to the top of cross beam 64 on the base, as by nut and bolt arrangements 276 and 278 as seen in FIGS. 5 and 10. The head end of drive tube 243 is positioned within the U bracket 270 to align sleeve 266 with aligned bores in the bracket sides 272 and 274, and a pin 281 is extended through the bores in sides 272 and 274 through sleeve 266 to pivotally secure the end of tube 243 in the bracket. The pin 281 is held in position by its head 283 and a lock ring 285. The clearance between the tube 243 and the bracket sides 272 and 274 is slight so that the bracket 270 resists lateral movement of the tube 243 and keeps tube 243 in alignment.

A conventional three-position rocker switch 288 which can be placed in a "feet up", off, or "feet down" position is mounted on the exterior face of seat side panel 100. The switch 288 has its terminals engaged to external wiring (not shown) to be plugged into an electrical outlet, and internal wiring (also not shown) from the switch terminals to the terminals of the motor 214 in the well-known manner so that when the switch 288 is placed in the "feet up" position, shaft 241 is rotated in a direction to drive the seat in an arcuate path toward the foot end of the base, and when the switch is placed in the "feet down" position, the seat is driven in an arcuate path toward the head end of the base. When the switch is in the "off" position, the gearing in box 216 holds the shaft 241 in a fixed position to hold the seat in a fixed position relative to the base.

OPERATION

Figure 3:
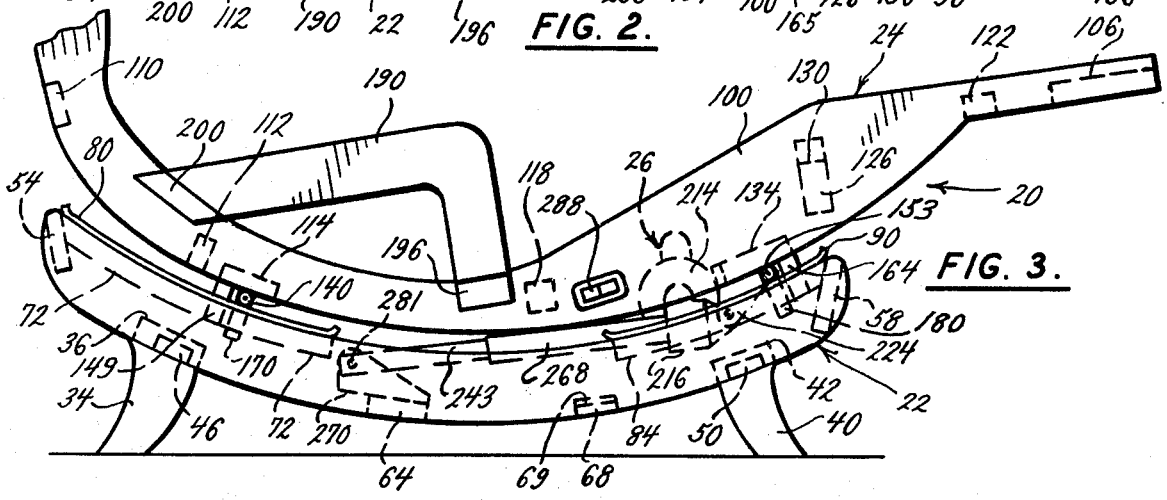
FIG. 3 is a front side view of the chair showing the foot end of the chair in its highest elevated position.

FIG. 1 shows the foot end of seat 24 in its lowest position while FIG. 3 shows the foot end of the seat in its highest position. To move the seat 24 from the low position of FIG. 1 to the elevated FIG. 3 position, the switch 288 is placed in the "feet up" position so that the threaded shaft 241 is driven through rider assembly 250 out of drive tube 243 to extend the drive and move the seat toward the foot end of the base. This action further separates the pins 238 on the top section and the pin 281 on the base. Upon such driving movement by the shaft 241, the seat rollers 140 and 153 roll along their respective arcuate tracks so that the seat moves in an arcuate path relative to the base. As this seat movement occurs, components of the power assembly 26 are also moved toward the foot end of the base 22.

During the foregoing movement, the power assembly 26 is allowed to pivot or rock relatively to the top section as pivot lug 221 pivots within bracket 224 with the parellel guiding ends 231 and 233 acting to resist lateral movement of the lug 221 so as to guide the pivoting of the power assembly. This pivoting and guidance thus allows the power assembly 26 components to move with the seat and maintain their alignment to prevent their being torn apart from their mounting to beam 134.

Also during the foregoing adjustments, at the head end of the power assembly 26, the drive tube 243 pivots about pin 281 within the U bracket 270 on the bases with the U bracket sides 272 and 274 acting to resist lateral movement of the drive tube 243 and the power assembly 26. The sleeve 266 within tube 243 engages the pin 281 along its length within tube 243 to resist shearing action between the pin 281 and the drive tube 243.

Thus the two brackets 229 and 270 allow the ends of the power assembly 26 to pivot, but yet offer guidance for the ends of the power assembly so that the power assembly does not become damaged or distorted during operation.

The pivotal engagement of the power assembly to the seat and to the base allows the power assembly 26 to follow the arcuate movement of the seat so that the power assembly 26 collides with neither the base cross beams 68 and 50, nor with the intermediate seat cross beam 118. The notch 69 in beam 68 allows for adequate clearance of the power assembly above beam 68, while the notch 137 in seat cross beam 134 allows the motor 214 to pivot freely without being resisted by contact against the mounting beam 134.

The retaining brackets 170 and 180 cooperate at both ends of the chair to keep the seat 24 from becoming detached from the base 22 during movement of the seat, should the seat or base be jarred during operation. The alignment beams 149 and 164 maintain alignment by engaging the arcuate support strips to also resist the seat from being thrown out of proper engagement with the base so that there is no lateral misalignment of the seat relative to the base during the operation.

Also, during the movement of the drive shaft 241 out of and into the drive tube 243, the drive tube 243 slides within the protective tube 268. The protective tube 268 thus acts with the drive tube 243 to enclose drive shaft 241 during the movement of the seat, thereby preventing foreign matter from coming into contact with the shaft 241 or rider assembly 250 and interfering with their operation.

Should it be necessary to perform maintenance upon the power assembly 26, or to replace it completely, the assembly 26 can be easily detached from the seat and base by simply disengaging pin 281 from tube 243 and disengaging pin 238 from lugs 221. The power assembly can then be removed from the connecting brackets and maintenance can be performed on the assembly without obstruction by the chair parts. After removal of the assembly, a repaired power assembly or a new power assembly can be installed within the brackets 224 and 270.

Although the description has shown the motor end of the power assembly as being secured to the seat, and the shaft end of the assembly as being secured to the base (and this is the preferred construction), the arcuate track arrangement of the base allows the base and seat transverse beams to be positioned so that the motor end can be attached to a base cross beam and the shaft end can be attached to a seat cross beam.

Thus it is understood that a novel arrangement for arcuately moving a chair seat relative to a chair base has been provided which can be operated to maintain alignment of the power assembly, the seat, and the base to allow ease in operation.

The mounting of the power drive mechanism is one that could be called underslung, in contrast to that in applicant's earlier U.S. Pat. No. 3,232,575. The motor drive 26 does not extend as high in the top section and does extend down into the bottom section. This permits the use of this drive with shallower top sections where desired. The extensible drive means is primarily located within the confines of the base 22. This enables the full set of cross members to be used in the movable top section where rigidity is particularly important. In the prior patent, the top section must be clear of braces in the area occupied during adjustments, by the bracket 72 and the shaft 58. In the present construction, these parts are located low in the base section so that the braces such as 118 can be used in the top section above the drive mechanism. At the same time bracing in the base section can be as numerous as in the earlier patent by the turning of them flatwise as illustrated. A comparison of FIG. 3 of this application with FIG. 3 of the patent indicates clearly that the sides of the bracket 270 in the present application are confined to the space between the side rails of the base and do not project into the area of the top section.

Another factor contributing to the compactness of the present structure is that the connection of the extensible screw drive to the base section is at the outer end of that drive, whereas in the former structure of the patent the connection is adjacent the lower end of that drive. Through the present arrangement, the maximum height of the outer end of the drive is determined by the position of the pivot 281 which has a constant elevation. In the construction of the earlier patent, the outer end of the screw drive 58 can move vertically over a significant distance as the drive is extended or contracted, and such isolation can interfere with the bracing and can require thicker side rails on the sections.

The direct drive feature of the present construction in place of the former belt drive improves the durability of the power mechanism and also eliminates one source of possible injury to the mechanism or to the user.

Various changes and modifications may be made within this invention as will be readily apparent to those skilled in the art. Such changes and modifications are within the scope and teaching of this invention as defined by the claims appended hereto.

What is claimed is:

1. A positionable chair comprising: a base having transverse support structure and curved, downwardly convex, longitudinally disposed support tracks; a top section having transverse support structure and having an upwardly concave top surface whereby parts of the body resting thereon may be higher than other points, the top section parts being in fixed relation to each other from end to end; means for movably supporting the top section upon the curved tracks so that the top section as a whole can move in a curved path relative to the base alternately to raise the foot or head portions of the chair; a power assembly comprising a motor and an extensible drive means connected together as a unit, the extensible drive means having a first portion operatively connected to and united with the motor and a second portion associated with the first portion and moved toward and away from the first portion upon operation of the motor; connecting means to pivotally connect one portion of the power assembly to the base transverse structure at a first point thereon; and other connecting means to pivotally connect the other portion of the power assembly to the top section transverse structure at a second point longitudinally separate from the first point, so that the power assembly can move the top section in the curved path relative to the base and the power assembly can pivot relative to the top section and to the base between the transverse support structure of the base and the top section during the curved movement; and said connecting means for the base and top section confining movement of the extensible means between the pivotal connections of the base and top section; the base section comprising side rails and the base transverse structure comprising transverse braces at intervals along the base side rails holding the side rails together; the top section being likewise formed of side rails and the top section transverse structure comprising transverse braces at intervals along the top section side rails holding those side rails together; the braces of the top section between the two points being above the bottom of the top section, and the braces of the base section being below the top thereof, to provide an open space in the sections between the first and second points; the motor portion of the power assembly being pivotally mounted on the underside of a brace of its section within said space and projecting therefrom toward the other section, and the second portion of the extensible drive means being pivotally connected to the upper side of a brace of the other section in the said space and projecting therefrom toward the first section, so that the power assembly can be extended and contracted, to move the top section in its curved path, without interference with the transverse braces; the connections on the base section being at least substantially wholly below the upper limits of the base section at the connections, and the connections on the top section being below the top thereof and depending below the top section, to dispose the extensible drive means at least largely below the top section.

2. The structure of claim 1 further comprising a first limiting member secured to the base transverse structure so that the first limiting member confines the power assembly to the base, and a second limiting member secured to the top section so that the second limiting member confines the power assembly about the pivotal engagement of the power assembly to the top section so that the first and secobnd limiting members maintain alignment of the power assembly with the chair.

* * * * *